United States Patent [19]

Victorovich et al.

[11] Patent Number: 4,802,916

[45] Date of Patent: Feb. 7, 1989

[54] COPPER SMELTING COMBINED WITH SLAG CLEANING

[75] Inventors: Grigori S. Victorovich, Toronto; Carlos M. Diaz; Charles E. O'Neill, both of Mississauga; James A. E. Bell, Oakville; Lloyd M. Timberg, Burlington, all of Canada

[73] Assignee: Inco Limited, Toronto, Canada

[21] Appl. No.: 827,086

[22] Filed: Feb. 7, 1986

[30] Foreign Application Priority Data

Mar. 20, 1985 [CA] Canada ..... 476986

[51] Int. Cl.[4] ..... C22B 15/00

[52] U.S. Cl. ..... 75/24; 75/26; 75/72

[58] Field of Search ..... 75/26, 72, 24

[56] References Cited

U.S. PATENT DOCUMENTS

| | | | |
|---|---|---|---|
| 3,674,463 | 7/1972 | Yannopoulos | 75/72 |
| 4,030,915 | 6/1977 | Aaltonen et al. | 75/74 |
| 4,388,110 | 6/1983 | Jensfelt et al. | 75/74 |
| 4,415,356 | 11/1983 | Victorovich et al. | 75/21 |
| 4,416,690 | 11/1983 | Richards et al. | 75/26 |
| 4,528,033 | 7/1985 | Andersson | 75/72 |

*Primary Examiner*—Melvyn J. Andrews

*Attorney, Agent, or Firm*—Raymond J. Kenny; Francis J. Mulligan, Jr.

[57] ABSTRACT

A process for autogenously smelting sulfidic copper material in the presence of a calcareous flux in which slag cleaning to provide metallic copper is employed. Such metallic copper provided by slag cleaning is usefully employed as a coolant in the autogenous smelting operation.

9 Claims, 1 Drawing Sheet

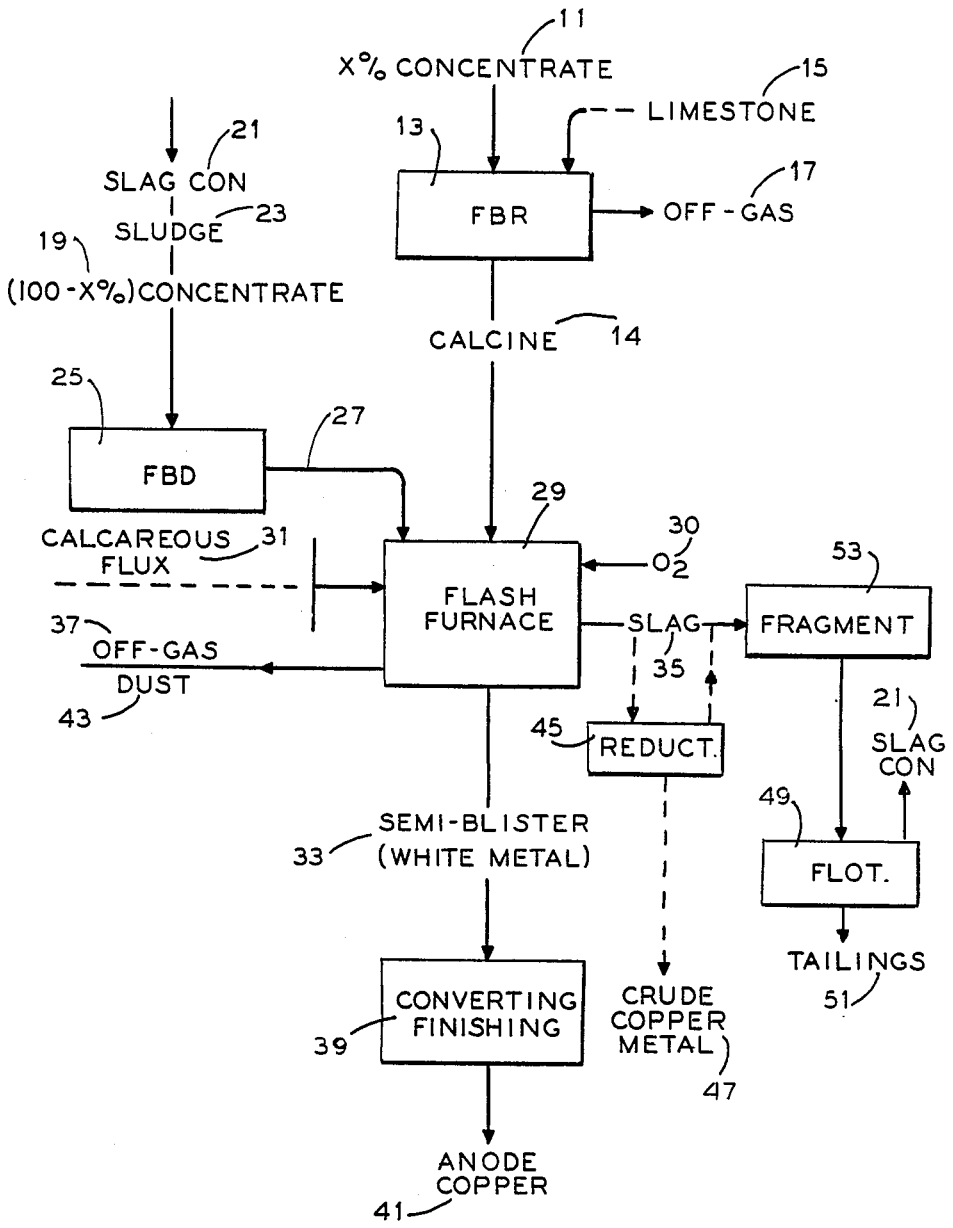
11
X% CONCENTRATE
15
LIMESTONE
13
FBR
17
OFF-GAS
21
SLAG CON
23
SLUDGE
19
(100-X%)CONCENTRATE
CALCINE
14
25
FBD
27
29
30
$O_2$
CALCAREOUS FLUX
31
FLASH FURNACE
53
FRAGMENT
SLAG
35
37
OFF-GAS
DUST
43
45
REDUCT.
21
SLAG CON
49
FLOT.
SEMI-BLISTER (WHITE METAL)
33
TAILINGS
51
CONVERTING FINISHING
39
CRUDE COPPER METAL
47
ANODE COPPER
41

COPPER SMELTING COMBINED WITH SLAG CLEANING

BACKGROUND OF THE INVENTION AND THE PRIOR ART

In U.S. Pat. No. 4,415,356 (the '356 patent) there is disclosed a process for autogenous oxygen smelting of sulfide materials containing base metals. The extensive prior art relating to autogenous smelting of copper and nickel sulfide materials is discussed in the '356 patent and the invention described therein is disclosed as:

> "The invention is based on the discovery that in the oxidation smelting the matte grade generated in the smelting furnace can be controlled by dividing the metal sulfide material stream to be smelted such that a portion of the stream is subjected to at least partial or even dead roasting, is then mixed with additional fresh metal sulfide material before being fed to the flash smelting furnace along with flux in the usual manner. This technique permits an upgrading in the matte grade produced, and is particularly applicable to oxygen flash smelting."

The '356 patent goes further to state:

> "It will be appreciated that the roasting step which forms part of the invention may be accomplished in equipment such as a fluid bed roaster. When this is done, a gas containing at least 10% of sulfur dioxide is produced which may be employed as feed for a sulfuric acid plant. In this way sulfur removed from the portion of concentrate which is roasted can be recovered and is not discharged to the atmosphere. Roasting in the fluid bed can be accomplished using air as the oxidant.
>
> The blend of roasted and dry unroasted concentrate, mixed with silicious flux, is injected into the smelting furnace in a stream of oxygen. The desired composition of matte to be obtained can be controlled by adjusting the ratio of calcine to green sulfide material in the feed. For a given concentrate, heat balance calculations will dictate the relative proportions of calcine and green sulfide material which have to be fed to yield the desired produce on autogenous smelting."

Thus, the '356 patent discloses a process in which sulfur dioxide is a product of the roasting step and that silicious flux is mixed with the blend of roasted and unroasted concentrate and injected into the smelting furnace. The '356 patent also discloses possible variations in the disclosed process in the following language:

> "It is preferred to dead roast only a proportion of concentrate fed to the smelter since in the way materials handling is minimized. Similarly, other sulfide materials equivalent in general metallurgical characteristics to sulfide concentrates, e.g., furnace mattes, can be treated in accordance with precepts of the invention. As noted hereinbefore, for a given sulfide material and a given furnace a sufficient amount of oxygen per unit weight of sulfides must be provided to supply the heat balance of the operation. Thus, for a given sulfide material, heat balance calculations will establish the relative proportions of calcined and uncalcined material to be employed, matte grade, or whether the given sulfide material is treatable by oxidation smelting. It will be apparent from the foregoing description that oxidation smelting, e.g., autogenous oxygen flash smelting, can be carried out in two stages. Thus copper concentrate can be flash smelted in a first operation to matte grade of about 55% while producing a slag which can be discarded; the matte can be granulated, ground and smelted in a second flash smelter to yield while metal or blister cooper with the slag from the second flash smelter being returned to the first smelter operation. Alternatively, the slag from the second operation can be slow cooled, concentrated and the concentrate returned. Calcine can be fed to either or both of the flash smelting operations along with the sulfide feed in accordance with heat balance requirements and to control product grade therefrom."

In gaining experience with the process of the '356 patent, applicant has found that the silica-based slags used in the patented process require a difficult slag cleaning operation in an electric furnace or slow cooling and flotation of copper metal to achieve good copper recovery. In addition, when blister copper is produced from iron-containing materials, the silica-based slags are viscous and contain high magnetite concentrations.

In U.K. published specification No. 2117410A of Oct. 12, 1983 it is disclosed that copper mattes may be autogenously combusted with oxygen in a flash furnace in the presence of a lime-ferrite slag. The principal source of lime-ferrite slag in the process of U.K. published Specification No. 2117410A is a recycled, non-magnetic fraction of flash furnace slag which has been treated by slow cooling, grinding and magnetic separation. The non-magnetic fraction of the slag which is disclosed as a recyclable feed, along with freshly ground matte for the flash furnace (together with make-up calcareous flux) contains the bulk of the copper and calcium in the slag.

U.S. Pat. No. 4,416,690 (the '690 patent) discloses the use of lime flux in the flash smelting of copper matte and the possible use of wide variety of coolants in this process. In the two examples given in this patent, no coolant is employed and there is no specific disclosure of any treatment of slag produced in the process.

OBJECT OF THE INVENTION

It is an object of the invention to provide a process for autogenous smelting of sulfide materials which is improved compared to the processes of the '356 and '670 patent and U.K. published Specification No. 2117410A.

DRAWING

The FIGURE of the drawing shows a flow diagram for the smelting process of the invention.

GENERAL DESCRIPTION OF THE INVENTION

The present invention contemplates a process of oxidizing sulfidic copper material to a copper metal product containing substantially no iron. This process comprises autogenously combusting a sulfidic copper material in a bounded space with an oxygen-containing gas in the presence of a coolant and a calcareous flux to thereby provide a lime-base slag containing essentially all the iron and silica present in said sulfidic copper material and coolant, a molten copper metal containing up to about 1.5% sulfur and an off-gas containing sulfur dioxide and thereafter cleaning said lime-base slag to recover metallic copper directly by said cleaning. Advantageously and preferably, the metallic copper recovered from the slag is recycled into the bounded space along with flux and sulfidic copper material as at least part of the coolant required to maintain temperature control in the process.

Sulfidic copper materials treated in accordance with the present invention include copper ore concentrates such as chalcopyrite ($CuFeS_2$) concentrate, bornite ($Cu_5FeS_4$) concentrate, chalcocite ($Cu_2S$) concentrate and other concentrates as well as sulfide mattes containing up to about 70% copper. Mattes contain little or no silica or other oxidic product. Concentrates however, generally include significant amounts of silica derived from rock components in the concentrate. When iron is present in the sulfidic copper material to be treated, or in any coolant or other material introduced into the autogenous combustion reaction, the weight ratio of iron to silica should be high.

In the present invention, autogenous combustion in a bounded space is specifically disclosed as flash smelting in an INCO-type flash smelting furnace such as described in Canadian Patent No. 503,446 (corresponding to U.S. Pat. No. 2,668,107). However, the present invention is applicable to any type of furnacing where the sulfur and iron, if any, content of the feed constitutes the principal source of the fuel to maintain furnace temperature and provide the heat necessary for carrying out the reaction. Examples of such furnaces include vortex furnaces, shaft furnaces, etc. The only basic criteria of suitable furnaces are that they confine the reactance and liquid products and that they enable gaseous products rich in sulfur dioxide to be treated prior to atmospheric discharge.

Calcareous fluxes useful in the process of the present invention are lime, slaked lime, calcium sulfate and limestone. It is important that these fluxes be low in magnesia in order to avoid much as possible high melting phases in the slag. Also, if iron is component of any feed material to the process, contents of silica in the feed materials entering the present process are important in that (A) there is a limited area in the $FeO-Fe_2O_3-CaO$ ternary diagram which represents lime ferrite slags molten at temperatures below about 1300° C. and that (B) reaction of lime with silica excludes such reacted limes from contributing to the $FeO-CaO-Fe_2O_3$ system. As discussed hereinafter, it is advantageous that the lime-base slag produced in the process of the invention have a ferric to ferrous ratio no greater than about 2.5 in order to be self-reducing with respect to copper oxice while the slag is in the liquid state. This $Fe^{3+}/Fe^{2+}$ ratio permits rapid slag cooling and adequate metallic copper formation by self reduction provided that the slag liquidus temperature is low enough to permit reduction to taken place in the liquid phase. This self reduction is especially effective if the $Fe_2O_3-FeO-CaO$ portion of the slag approximates in weight percent 21% CaO, 47% $Fe_2O_3$ and 32% FeO and contains on cooling, the phase $CaO-FeO-Fe_3O$ (CM). If too much lime is withdrawn from this portion of the slag, for example as $2CaO-SiO_2$ the melting point in the $Fe_2O_3-FeO-CaO$ system will exceed 1300° C. and, if at the same time, the $Fe^{3+}$ to $Fe^{2+}$ ratio increases, the phase $4CaO-FeO-4Fe_2O_3$ (CFF) appears on cooling, which phase is usually associated with undesireable high tailings loss of copper in slag cleaning. Slags containing an amount of FeO greater than 32% by weight have a greater tolerance for lower lime in the $CaO-FeO-Fe_2O_3$ system while in maintaining a melting point below 1300° C. However such slags are difficult to obtain given the normal oxidizing environment of an autogenous smelting furnace.

In accordance with the present invention slag cleaning is an operation which directly produces and separates metallic copper from the slag. It is thus distinguished from the magnetic separation operation of U.K. published Specification No. 2117410A discussed hereinbefore in which the slag is slow cooled, ground and subjected to magnetic separation to provide a nickel-iron-rich ferromagnetic material and non-ferro-magnetic cooper-lime-rich material. Essentially no metallic copper is produced in the magnetic separation operation. In contrast, in the process of the present invention, the slag-cleaning operation comprises the slag self-reduction step as discussed hereinbefore or a slag reduction operation using reductants such as coke, iron in finely divided form, aluminum metal, pyrites etc. followed by flotation of the slag in pulverized form. Flotation using normal xanthate collectors, produces a tails containing an average of about 0.7% by weight copper and a flotation product containing as high as 65% copper metal.

Collant used in the autogenous furnace when carrying out the process of the present invention preferrably is any inert or oxidic copper-containing material. Advantageously, metallic copper produced by cleaning slag is at least part of the coolant. Another coolant and/or recycle material is sludge produced from fines collected from the autogenous smelting off-gas. These fines which comprise partially oxidized sulfide feed material, gypsum (a form of calcium sulfate) and copper hydroxide are collected by wet Cottrell precipitation and are dried prior to use in the autogenous smelter. A most advantageous coolant used in the process of the present invention is the product of roasting or partially roasting copper concentrate (essentially chalcopyrite concentrate) in the presence of limestone at a temperature of about 850° C. to 1000° C. The fully roasted product essentially comprises a mixture of calcium sulfate and oxidic copper e.g. copper ferrite with the partially roasted product containing these materials and some heat modified sulfide concentrate. In addition to these copper-containing coolants, inert materials such as water, recirculated sulfur dioxide, cooled slag, etc. can also be used as coolant.

PARTICULAR DRESCRIPTION OF THE INVENTION

A most advantageous aspect of the present invention is more particularly described in conjunction with the drawing. Referring now thereto a chalcopyrite concentrate containing about 28% to 30% copper is divided into two portions. The first portion designated X% concentrate 11 is roasted in fluid bed roaster 13 at 850° C. to 1000° C. either by itself to form an oxidic calcine 14 comprising mainly $CuFe_2O_4$ and an $SO_2$-containing off-gas 17 or in the presence of limestone 15 to form a calcine 14 containing $CuFe_2O_4$, $CaSO_4$ and CaO and carbon dioxide off-gas 17.

The other portion of the chalcopyrite concentrate designated (100−X)% concentrate 19 is introduced along with slag concentrate 21 and sludge 23 into fluid bed drier 25. The product 27 of fluid bed drier 25 is fed along with calcine 14 into flash furnace 29 along with combustion oxygen 30. If limestone 15 in sufficient quantity to provide for slag needs has been roasted in fluid bed roaster 13 then calcine 14 will contain slag-forming lime either as CaO or $CaSO_4$ and only calcine and product 27 of fluid bed drier 25 comprises the solid feed to flash furnace 29. On the other hand if no limestone 15 or insufficient (vis-a-vis slag) limestone 15 has passed through fluid bed roaster 13, then calcareous flux 31 is a necessary solid feed material to flash furnace 29. For flash furnace 29, (100−X)% concentrate 19, calcine 14, slag concentrate 21, sludge 23 and limestone, slaked lime or lime 31 (if any) are preferably correlated in amounts such that the operation of flash furnace 29 is autogenous without excess heat which would superheat slag, metal and furnace components. If the operation of flash furnace 29 cannot be maintained practically autogenous, means can be provided, as are well known to those of normal skill in the art, for supplying fuel for for additional heat or auxiliary coolant for dissipating heat.

Flash furnace 29 has three products, copper metal 33, slag 35 and off-gas 37. Copper metal 33 is advantageously maintained at a semi-blister grade, this grade being definable as copper metal along with a small, visually observable amount of white metal ($Cu_2S$). The copper metal product 33 is subsequently subjected to a conventional converting or finishing operation 39 to produce anode copper 41 suitable for electrorefining. Off-gas 37 contains or essentially consists of sulfur dioxide and carries with it dust 43. Some of dust 43 is recovered dry from cyclones or similar collectors. The bulk of the remaining dust 43 is precipitated electrostatically and forms sludge 23 with water. As disclosed hereinbefore sludge 23 is a feed material to fluid bed drier 25. If desired, sludge 23 can be treated to remove undesirable components e.g., bismuth, prior to being recycled through fluid bed drier 25. If limestone 31 is used as a direct feed to flash furnace 29, off-gas 37 will contain significant amounts of carbon dioxide as well as sulfur dioxide. This mix of gases is adaptable for use in sulfuric acid production as a means of producing a useful product and avoiding atmospheric contamination. If lime and calcium sulfate derived from limestone 15 enters flash furnace 29 in the form of calcine 14, the off-gas from flash furnace 29 consists primarily of sulfur dioxide, which gas can be used for liquid $SO_2$ production as well as for production of sulfuric acid.

Molten slag 35 as a product of flash furnace 29 upon cooling will self-reduce (with respect to copper) provided the ferric to ferrous ratio of slag 35 is not too high. This self-reduction of copper employs the reaction:

$$Cu_2O + 3FeO \rightarrow 2Cu + Fe_3O_4$$

If the ferric to ferrous molar ratio of slag 35 is in excess of about 3, it is likely that the copper content of slag 35 will be high e.g., above about 12% and that a goodly portion of this copper content will be and remain on cooling as oxidic copper. On the other hand, if the ferric to ferrous molar ratio of slag 35 is about 2 the copper content of slag 35 will likely be below 10% and, on cooling, the bulk of this copper content e.g., 90% will be in elemental form. As depicted in the drawing, slag 35 can be subjected to reduction operation 45 if the $Fe^{3+}/Fe^{2+}$ is too high. This reduction operation can be a conventional slag fuming operation involving any available carbonaceous gas, liquid or solid reductant with air injection to provide partial combustion of the reductant. The product of slag fuming is crude copper metal 47, some iron and essentially copper free slag. The crude copper metal is recycled to flash furnace 29. More advantageously, reduction operation 45 can comprise contacting slag 35 with a finely divided coke or metal reductant during the cooling of slag 35. The reductant reacts very rapidly so that, under normal cooling conditions, cooled slag 35 produces a solid in which copper is present primarily in metallic form. As an alterantive to finely divided coke or metal reductant, a sulfidic reductant can be used resulting in formation of metallic and sulfidic copper in cooled slag 35. When slag 35 is cool and in fragmented condition suitable for flotation, it is floated by conventional technology in flotation unit 49 to provide slag concentrate 21 and tailings 51. Slag concentrate 21 consisting principally of copper metal with or witout cooper sulfide is then reverted through fluid bed drier 25 to flash furnace 29.

In the drawing between slag 35 and flotation unit 49 an operation "fragmentation" 53 has been indicated. As in conventional technology fragmentation 53 can include the usual steps of crushing and grinding to provide a flotation feed. However, provided that slag 35 is properly constituted, it has been found the mere act of cooling slag 35 will cause decrepitation to a state which minimizes or eliminates conventional milling operations.

Those skilled in the art will appreciate that the process of the invention as described in conjunction the drawing can be varied substantially without departing from the ambit of the invention. For example, instead of dividing a chalcopyrite concentrate into two parts, various concentrates or matte products depending on the availability of material could either be calcined or could bypass calcination to provide any flow of material as desired. Calcine 14 can be replaced whole or in part by naturally occurring low silica, oxidic copper ores. Limestone can be any reasonable low magnesia commercial grade of available material. In addition, lime can be used as a feed to fluid bed roaster 13 in place of all or part of limestone 15. Roasting can be carried out using air or air enriched with oxygen as the oxidizing medium so long as the roasting temperature is maintained at a maximum of about 1000° C. At temperatures above 1000° C. calcium sulfate will start to decompose and agglomeration of copper-containing oxidic product will result. Roasting at temperatures below about 850° C. is normally very slow and incomplete. In flash furnace 29, the copper product grade is generally determined by the ratio of gaseous oxygen to sulfur in the total solids fed to the smelter. Copper product advantageously ranges from semi-blister to blister copper.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which a exclusive property or privilege is claimed are defined as follows:

1. A process of oxidizing sulfidic copper ore concentrate containing iron and having a high iron to silica weight ratio to a copper metal product containing substantially no iron comprising charging to and autogenously combusting said sulfidic copper material containing iron in a bounded space with an oxygen-containing gas in the presence of a coolant at least part of which is a roasted copper concentrate and a calcareous flux to thereby provide a copper oxide-containing slag based upon the components CaO, FeO and $Fe_2O_3$ containing essentially all the iron and silica charged to said bounded space, a molten copper metal containing a small amount of white metal and an off-gas containing sulfur dioxide and thereafter cleaning said slag to recover metallic copper directly by said cleaning.

2. A process as in claim 1 wherein metallic copper recovered by said cleaning is reverted to said bounded space.

3. A process as in claim 1 wherein said bounded space is a flash furnace.

4. A process as in claim 1 wherein iron present in said slag based upon the components $Fe_2O_3$-FeO-CaO has an $Fe^{3+}$ to $Fe^{2+}$ ratio no greater than about 2.5.

5. A process as in claim 1 wherein after slag is separated from said molten copper metal, reductant is added to said slag to reduce oxidic copper in said slag.

6. A process as in claim 1 wherein said calcareous flux is selected from the group consisting of lime, slaked lime, calcium sulfate and limestone.

7. A process as in claim 1 in which flue dust from said bounded space is employed as part of said coolant.

8. A process as in claim 7 wherein coke is employed as said reductant.

9. A process as in claim 1 wherein metallic copper recovery from said slag is accomplished by flotation of fragmented slag.

* * * * *